US008544782B2

(12) United States Patent
Musschoot et al.

(10) Patent No.: US 8,544,782 B2
(45) Date of Patent: Oct. 1, 2013

(54) LINER FOR DRUM AND METHOD OF ASSEMBLY

(75) Inventors: Thomas P. Musschoot, Marengo, IL (US); Steve Massman, Poplar Grove, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 847 days.

(21) Appl. No.: 12/341,262

(22) Filed: Dec. 22, 2008

(65) Prior Publication Data

US 2009/0162137 A1 Jun. 25, 2009

Related U.S. Application Data

(60) Provisional application No. 61/015,480, filed on Dec. 20, 2007.

(51) Int. Cl.
*B02C 17/22* (2006.01)

(52) U.S. Cl.
USPC ..... 241/183; 241/181; 241/278.2

(58) Field of Classification Search
USPC ..... 241/182, 183, 278.2, 277, 299, 300
See application file for complete search history.

(56) References Cited

U.S. PATENT DOCUMENTS

| | | | | | |
|---|---|---|---|---|---|
| 839,491 | A | * | 12/1906 | Lohnert | 241/183 |
| 851,013 | A | * | 4/1907 | Lohnert | 241/183 |
| 860,782 | A | * | 7/1907 | Abbe | 241/80 |
| 1,207,174 | A | * | 12/1916 | Johnson | 241/183 |
| 1,243,742 | A | * | 10/1917 | Johnson | 241/183 |
| 1,534,000 | A | * | 4/1925 | Baker | 241/183 |
| 1,921,672 | A | * | 8/1933 | Haushalter | 241/183 |
| 1,986,530 | A | * | 1/1935 | Read | 241/183 |
| 2,611,546 | A | | 9/1952 | Posselt | |
| 2,692,087 | A | | 10/1954 | Hartshorn | |
| 3,802,634 | A | * | 4/1974 | Mix | 241/183 |
| 3,998,262 | A | | 12/1976 | Didion | |
| 4,177,955 | A | * | 12/1979 | Miller | 241/183 |
| 4,194,710 | A | * | 3/1980 | Ebner | 241/182 |
| 4,270,705 | A | * | 6/1981 | Larsen | 241/183 |
| 4,295,615 | A | * | 10/1981 | Mishek | 241/182 |
| 4,365,763 | A | * | 12/1982 | Guerguerian | 241/70 |
| 4,502,808 | A | | 3/1985 | Didion et al. | |
| 4,674,691 | A | | 6/1987 | Didion | |
| 4,981,581 | A | | 1/1991 | Didion | |

(Continued)

OTHER PUBLICATIONS

International Search Report and Written Opinion from counterpart PCT application (dated Mar. 13, 2009) (9 pages).

*Primary Examiner* — Yogendra Gupta
*Assistant Examiner* — Emmanuel S Luk
(74) *Attorney, Agent, or Firm* — Marshall, Gerstein & Borun LLP

(57) ABSTRACT

A lined drum includes a drum having a wall with an inner surface. The lined drum also includes a plurality of liner segments, each liner segment having inner and outer opposing surfaces, opposing side edges, and opposing end edges, the outer surface of the liner segment facing the inner drum surface and the side edges of adjacent liner segments being spaced from each other to define a space therebetween, and at least one retainer having opposing side edges overlapping the side edges of the adjacent liner segments, the at least one retainer attached to the wall of the drum in the space between the side edges of the adjacent liner segments. The lined drum may also include a plurality of bar segments, each bar segment attached to the wall of the drum and at least one retainer.

19 Claims, 9 Drawing Sheets

(56) References Cited

U.S. PATENT DOCUMENTS

| | | | | | |
|---|---|---|---|---|---|
| 5,016,827 | A | | 5/1991 | Didion | |
| 5,095,968 | A | | 3/1992 | Didion | |
| 5,267,603 | A | | 12/1993 | Didion | |
| 5,581,902 | A | | 12/1996 | Didion et al. | |
| 5,613,902 | A | | 3/1997 | Didion et al. | |
| 5,638,887 | A | | 6/1997 | Didion | |
| 5,638,890 | A | | 6/1997 | Didion et al. | |
| 5,794,865 | A | | 8/1998 | Didion et al. | |
| 5,950,944 | A | * | 9/1999 | Larsen | 241/183 |
| 6,082,646 | A | * | 7/2000 | Clarke et al. | 241/182 |
| 6,273,176 | B1 | | 8/2001 | Didion | |
| 6,343,756 | B1 | * | 2/2002 | Weil | 241/299 |
| 6,595,267 | B2 | | 7/2003 | Didion et al. | |
| 6,896,400 | B2 | | 5/2005 | Didion | |
| 6,913,215 | B2 | * | 7/2005 | Gildersleeve et al. | 241/182 |
| 7,198,217 | B2 | * | 4/2007 | Gildersleeve et al. | 241/299 |
| 7,204,636 | B2 | | 4/2007 | Didion | |
| 7,559,725 | B2 | | 7/2009 | Mathis et al. | |
| 7,861,960 | B2 | * | 1/2011 | Bhide | 241/299 |
| 2002/0023729 | A1 | | 2/2002 | Didion et al. | |
| 2007/0029063 | A1 | | 2/2007 | Didion | |

* cited by examiner

LINER FOR DRUM AND METHOD OF ASSEMBLY

This application claims the benefit of U.S. Provisional Patent Application 61/015,480, filed Dec. 20, 2007, which application is incorporated herein by reference in its entirety.

BACKGROUND

This patent is directed to a liner and a method for its assembly, and, in particular, to a liner for a drum and a method for its assembly in the drum.

Lined drums are known in the art. For example, U.S. Pat. Nos. 4,502,808, 6,273,176, and 6,595,267 illustrate various different liners for drums that rotate about an axis. Such drums should be contrasted, for example, with drum-shaped chambers that do not revolve about an axis, but instead where a rolling motion is induced in the material in the chamber according to vibrational forces applied to the drum-shaped chamber. With a drum that revolves about an axis, sections of the liner are disposed above a horizontal plane in which the axis lies, with some sections of the liner advancing to the highest point above this plane and other sections passing through and away from the highest point above this plane. With a drum where the material follows a rolling motion according to applied vibrational forces, the liner actually does not move significantly between higher and lower elevations. Thus, the forces applied to a liner are significantly different depending on the operational method of the drum.

SUMMARY

According to an aspect of the present disclosure, a lined drum includes a drum including a wall with an inner surface. The lined drum also includes a plurality of liner segments, each liner segment having inner and outer opposing surfaces, opposing side edges, and opposing end edges, the outer surface of the liner segment facing the inner drum surface and the side edges of adjacent liner segments being spaced from each other to define a space therebetween, and at least one retainer having opposing side edges overlapping the side edges of the adjacent liner segments, the at least one retainer attached to the wall of the drum in the space between the side edges of the adjacent liner segments.

According to another aspect of the present disclosure, a liner kit for a drum with a wall having an inner surface includes a plurality of liner segments, each liner segment having inner and outer opposing surfaces, opposing side edges, and opposing end edges, the outer surface of the liner segment adapted to face the inner surface of the drum with the side edges of adjacent liner segments being spaced from each other to define a space therebetween. The liner kit also includes at least one retainer having opposing side edges to overlap the side edges of the adjacent liner segments, the at least one retainer attachable to the wall of the drum in the space between the side edges of the adjacent liner segments.

According to yet another aspect of the present disclosure, a method of assembling a liner in a drum having an inner surface includes disposing a liner segment having inner and outer surfaces, opposing side edges, and opposing end edges in the drum with the outer surface of the liner segment facing the inner surface of the drum. The method further includes disposing an adjacent liner segment having inner and outer surface, opposing side edges and opposing end edges in the drum with the outer surface of the adjacent liner segment facing the inner surface of the drum with one of the side edges of the adjacent liner segment spaced from one of the side edges of the liner segment to define a space between the liner segments. Additionally, the method includes attaching a retainer having opposing side edges overlapping the side edges of the liner segments to the wall of the drum in the space between the side edges of the liner segments.

According to a further aspect of the present disclosure, a lined drum includes a drum including a wall with an inner drum surface. The lined drum also includes a plurality of bar segments, each bar segment having inner and outer opposing ends, opposing side edges, and opposing end edges, the outer end of each bar segment attached to the wall of the drum. The lined drum further includes a plurality of liner segments, each liner segment having inner and outer opposing surfaces, opposing side edges, and opposing end edges, the outer surface of the plurality of liner segment facing the inner surface of the drum, a side edge of one of the plurality of liner segments and a side edge of an adjacent liner segment facing the opposing side edges of one of the plurality of bar segments. The lined drum also includes at least one retainer having opposing side edges overlapping the side edges of the adjacent liner segments, the at least one retainer attached to the inner end of one of the plurality of bar segments.

According to a still further aspect of the present disclosure, a liner kit for a drum with a wall having an inner surface includes a plurality of bar segments, each bar segment having inner and outer opposing ends, opposing side edges, and opposing end edges, and a plurality of liner segments, each liner segment having inner and outer opposing surfaces, opposing side edges, and opposing end edges, one of the side edges of the liner segments and a side edge of an adjacent liner segment positionable to face the opposing side edges of one of the plurality of bar segments. The kit further includes at least one retainer having opposing side edges capable of overlapping the side edges of the adjacent liner segments, the at least one retainer attachable to the inner end of the opposing bar segment.

According to an additional aspect of the present disclosure, a method of assembling a liner in a drum includes attaching to a wall of the drum a plurality of bar segments, each of the plurality of bar segments having inner and outer opposing ends and opposing side edges. The method also includes disposing a liner segment having inner and outer surfaces, opposing side edges, and opposing end edges in the drum with the outer surface of the liner segment facing the wall of the drum and one side edge of the liner segment facing the side edge of one of the plurality of bar segments. The method further includes disposing an adjacent liner segment having inner and outer surface, opposing side edges and opposing end edges in the drum with the outer surface of the adjacent liner segment facing the wall of the drum and one side edge of the adjacent liner segment facing the side edge of the one of the plurality of bar segments. Additionally, the method includes attaching a retainer having opposing side edges overlapping the side edges of the liner segments to the inner end of the opposing bar segment.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
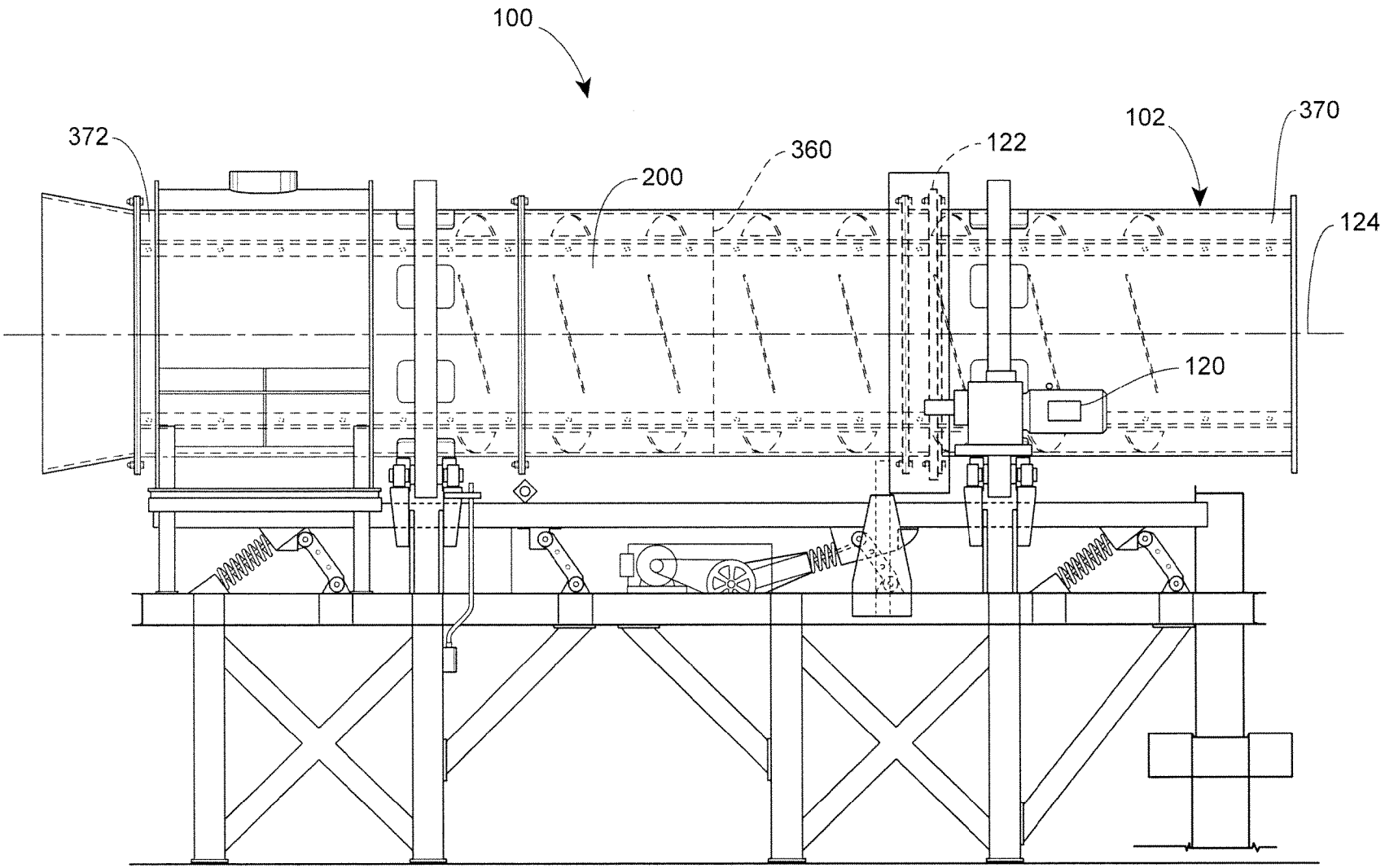
FIG. 1 is a side view of a drum with a plurality of liner segments mounted therein.
Figure 2:
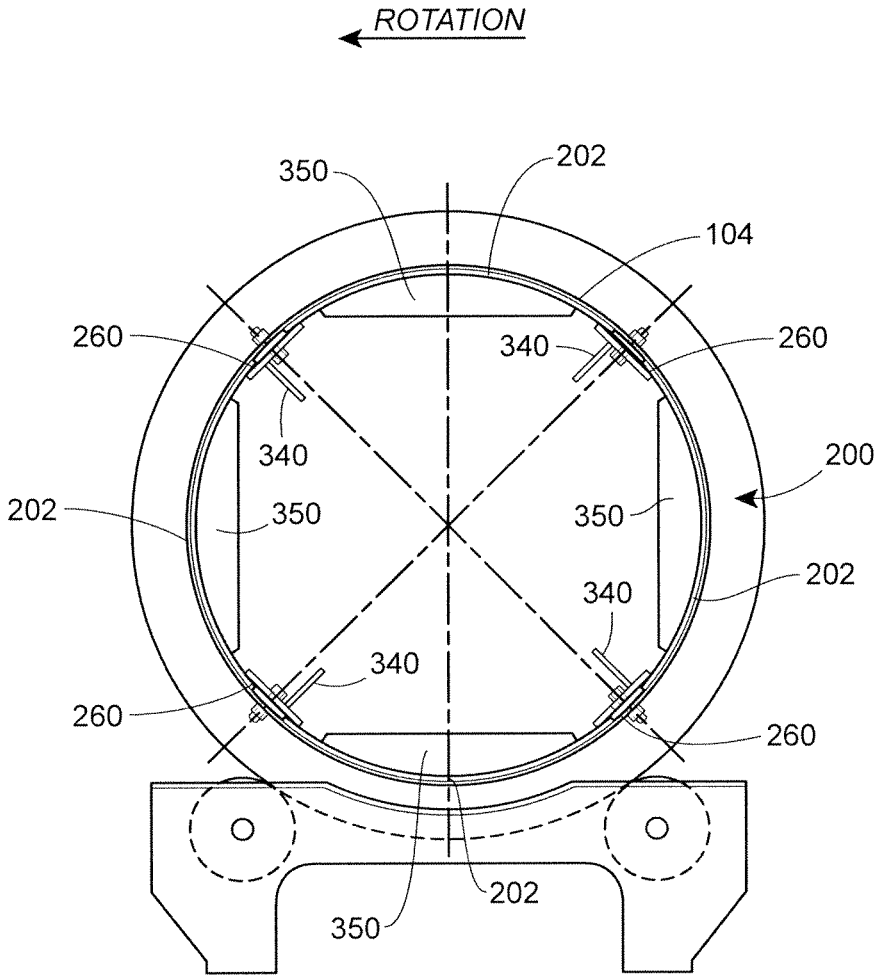
FIG. 2 is an end view of the drum of FIG. 1, illustrating the plurality of liner segments mounted in the drum, retainers and mechanisms for attaching the retainers to the drum.
Figure 7:
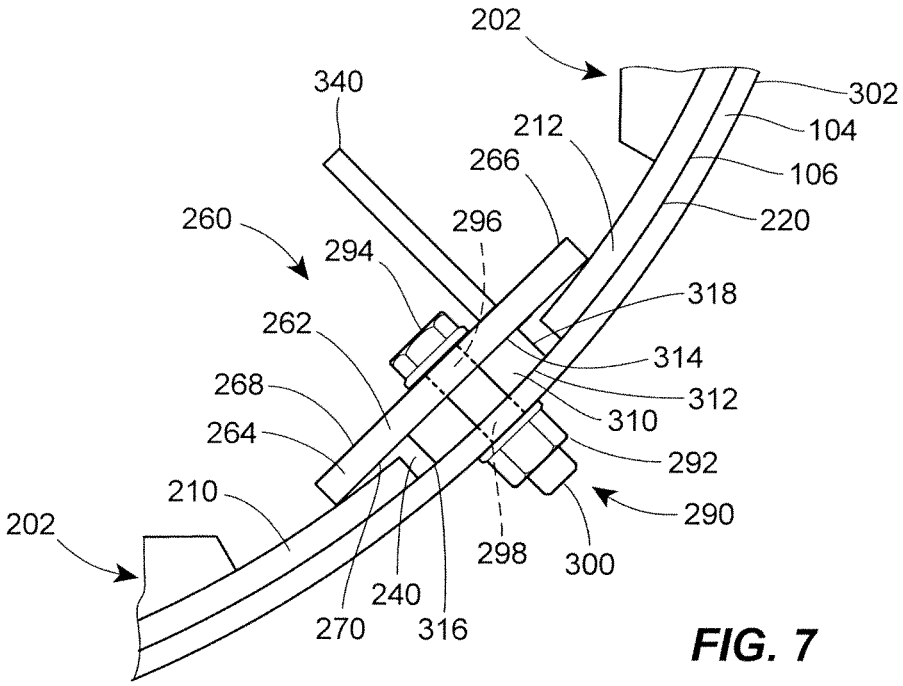
FIG. 7 is an enlarged, fragmentary end view of the liner segments, retainers, and mechanism for attaching the retainers to the drum.

Referring first to FIG. 1, an apparatus 100 is provided. The apparatus 100 includes a drum 102. The drum 102 has a wall 104, as best seen in FIGS. 2 and 7. The wall 104 of the drum 102 has an inner surface 106. The inner surface 106 of the wall 104 of the drum 102 is curved as illustrated; in fact, as illustrated, the cross-section of the drum 102 is circular. It will be recognized, however, that the cross-section of the drum is not limited to a circular cross-section, and that other cross-sectional shapes are also possible. The wall 104 of the drum 102 may be made of metal.

The apparatus 100 may include one or more mechanisms for moving the drum 102 so as to move objects within the drum 102. For example, the drum 102 may have a motor 120 with an associated drive 122 that is coupled to the drum 102 to cause the drum 102 to rotate about an axis collinear with a longitudinal axis 124 of the drum 102. The drive 122 may include one or more gears, with a first gear attached to the shaft of the motor 120. While the apparatus as illustrated is a DUCTA-Series Rotary Media Drum, available from General Kinematics Corp. of Crystal Lake, Ill., it will be recognized that the present disclosure is not limited to only such apparatuses 100. For example, the drive 122 may cause the drum 102 to rotate about an axis that is not collinear with the longitudinal axis of the drum 102.

Figure 3:
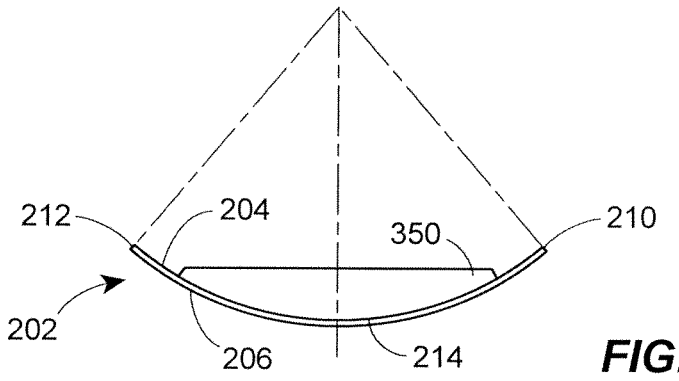
FIG. 3 is an end view of one of the plurality of liner segments illustrated in FIGS. 1 and 2.

As seen in FIGS. 1 and 2, the drum 102 has a liner 200. The liner 200 includes a plurality of liner segments 202, as better seen with reference to FIGS. 3-5. Each liner segment 202 has inner and outer opposing surfaces 204, 206. The segments 202 also have opposing side edges 210, 212 and opposing end edges 214, 216. While the side edges 210, 212 and end edges 214, 216 are parallel as illustrated, the present disclosure would also embrace embodiments wherein the side edges 210, 212 and end edges 214, 216 were not parallel. In fact, the edges 210, 212, 214, 216 may be irregular, or shaped so that adjacent edges 210, 212, 214, 216 of adjacent segments 202 are complementary according to geometry other than that shown (i.e., where all edges are straight and parallel). The liner segment 202 also has a thickness between the inner and outer opposing surfaces 204, 206. According to at least one embodiment, the segments 202 may be made of metal.

As illustrated, the outer surface 206 of the liner segment 202 is curved. In particular, the outer surface 206 of the liner segment 202 is curved so as to be complementary to the curved inner surface 106 of the wall 104 of the drum 102. As such, where the cross-section of the drum 102 is circular, the outer surface 206 of the liner segment 202 will represent a sector of a circle having the same center as that of the drum 102 with the inner surface 106 of the drum 102 significantly abutting the outer surface 206 of the liner segment 202 with the outer surface 206 facing the inner surface 106, or maintaining a uniform spacing therebetween.

It will be recognized that the inner surface 106 of the drum 102 and the outer surface 206 of the liner segments 202 need not be complementary. That is, it may be possible for the drum 102 to have a circular cross-section, but the curvature of the outer surface 206 of the liner segment 202 to be such that the spacing between the inner surface 106 of the drum 102 and the outer surface 206 of the liner segment 202 is not uniform, but may vary between the side edges 210, 212 of the liner segment 202. For example, points on a line equidistant from the edges 210, 212 may be abutting or closer to the inner surface 106 of the drum 102 than points on either edge 210, 212.

As seen in FIG. 7, a layer 220 may be disposed between the inner surface 106 of the drum 102 and the outer surface 206 of the liner segment 202 where a spacing (uniform or non-uniform) exists between the inner surface 106 and the outer surface 206. The layer 220 may be made of an insulating material. The insulating material may limit the transmission of heat and/or sound between the liner segments 202 and the drum 102, for example. According to one embodiment, the layer 220 may be made of paper. Alternatively, the layer 220 may be defined by a material that is applied to surface 106, surface 206, or both surfaces 106, 206.

As illustrated, the thickness of the liner segments 202 is uniform, such that the shape of the inner surface 204 of the liner segment 202 generally follows the shape of the outer surface 206. Consequently, where the outer surface 206 is complementary to the circular wall 104 of the drum 102, the inner surface 204 has the same general curvature. As such, if the curvature of the outer surface 206 were changed, while the thickness of the liner segment 202 remained uniform, it would be possible to have, for example, a drum 102 of circular cross-section but with a chamber defined by the liner 200 that had, instead, an elliptical cross-section. For that matter, the thickness of the liner segments 202 need not be uniform, such that the same result (i.e., a drum 102 of circular cross-section with an elliptical chamber) could be achieved instead by varying the thickness of the liner segments 202 between their side edges 210, 212. Other alternative are also possible.

Returning to FIG. 7, it will be observed that the side edges 210, 212 of adjacent liner segments 202 are spaced from each other to define a space 240 therebetween. The space 240 may permit the movement of the side edges 210, 212 relative to each other, for example to permit thermal expansion or contraction. Furthermore, the space 240 is used to attach the liner segments 202 to the wall 104 of the drum 102 according to the following mechanism.

At least one retainer 260 is provided for every two liner segments 202 (see FIG. 2). The retainer 260 overlaps the side edges 210, 212 of adjacent liner segments 202. In particular, as seen in FIG. 7, the retainer 260 includes a plate 262 having opposing side edges 264, 266 that overlap the side edges 210, 212 of adjacent liner segments 202. The retainer 260 is attached to the wall 104 of the drum 102 in the space 240 between the side edges 210, 212 of adjacent liner segments 202. In doing so, the liner segments 202 are attached to the wall 104 of the drum 102.

Similar to the liner segments 202, the plate 262 has inner and outer surfaces 268, 270 and opposing ends 276, 278 (see FIG. 6) with the outer surface 270 facing the inner surface 204 of the liner segments 202 with the retainer 260 in its operative position in the drum 102. A thickness is defined between the inner and outer surfaces 268, 270, and while this thickness is uniform between the sides 264, 266 in the embodiment illustrated, this need not be the case according to all embodiments. For that matter, it will be recognized that the plate 262 is planar (i.e., not curved) as illustrated; according to other embodiments, the plate 262 may be curved as well, and the outer surface 270 may be complementary to the inner surface 204 of the liner segments 202. According to at least one embodiment, the retainers 260 may be made of metal.

One mechanism for attaching the retainer 260 to the wall 102 is illustrated. According to this embodiment, the retainer 260 is attached to the wall 102 through the use of a fastener 290, such as a nut 292 and bolt 294 combination. To facilitate the use of the fastener 290, the plate 262 may have at least one aperture 296 and the wall 104 may have at least one aperture 298. With the apertures 296, 298 aligned, the bolt 294 may be disposed through the apertures 296, 298, and the nut 292 threaded on to an end 300 of the bolt 294 depending beyond an outer surface 302 of the wall 104 of the drum 102.

It will be recognized that the foregoing is merely an example of one mechanism for attaching the retainer 260 to the wall 102. Other mechanisms may be used. For example, the bolt 294 may have an end fixedly attached to the inner surface 106 of the wall 104 of the drum, by welding, for example. Alternatively, the mechanism may permit the plate 262 to be moved inwardly (i.e., toward the center of the drum 102) relative to the liner segments 202 while limiting separation of the plate 262 entirely from the drum 102. Other alternatives are possible.

It may be desired to place an element in the space 240 so as to fill a portion of the space 240 not filled by the fastener 290. This element, which may be referred to as a spacer 310 and is best seen in FIG. 7, may have an outer surface 312 that abuts the inner surface 106 of the drum 102, and an inner surface 314 that abuts the outer surface 270 of the plate 262. As illustrated, the spacer 310 may be welded to the inner surface 106 of the drum 102. Accordingly the spacer 310 may facilitate the relative arrangement of the liner segments 202 about the inner surface 106 of the drum 102. According to the illustrated embodiment, the spacer 310 has opposing sides 316, 318 that face side edges 210, 212 of adjacent liner segments 202. However, the sides 316, 318 are spaced from the edges 210, 212 to permit the movement of the edges 210, 212 in response to thermal effects, as discussed above.

The spacer 310 may have a passage formed through from the inner surface 314 to outer surface 312 to permit the fastener 290 to be disposed therethrough. For that matter, the spacer may have a thickness measured between the inner and outer surfaces 312, 314 that is substantially equal to that of the liner segments 202, or at least the region of the liner segments 202 immediately adjacent the spacer 310.

The inner surface 204 of the liner segments 202 and the inner surface 268 of the plate 262 may have all manner of surface texturing. That is, the surfaces 204, 268 may be dimpled, perforated, rifled, etc. The surface texturing of the surfaces 204 of the liner segments 202 may differ from the texturing of the surfaces 268 of the plates 262. Moreover, the texturing may differ between different ones of the liner segments 202 and/or the plates 262.

Figure 6:
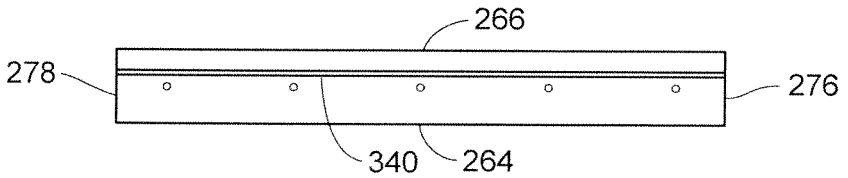
FIG. 6 is a plan view of the retainers illustrated in FIG. 2.

Similarly, one or more projections may be attached to the inner surfaces 204 of the liner segments 202 and the inner surfaces 268 of the plate 262. As illustrated, a projection 340 is attached to the inner surface 268 of the plate 262 and extends along the plate 262 from one end 276 to the other 278 (FIG. 6). When the plates 262 are attached to the drum 102, these projections 340 will be radially aligned within the drum 102. As also illustrated, at least one projection 350 is attached to the inner surface 204 of the liner segments 202; in fact, three such projections 350 are attached to the liner segment 202. When the liner segments 202 are attached to the drum 102, these projections 350 will lie in a plane that intersects the longitudinal axis 124 of the drum 102 at an angle.

Of course, the illustrated embodiments are merely exemplary, and other embodiments may have projections that are longer or shorter than those shown, or include more projections or fewer projections relative to a single segment or retainer. Also, the projections may be attached to the segment or projection by welding, for example, or the projections may be formed integrally with the segment or projection. The projections may also have surface texturing, such as dimples, perforations, etc.

Figure 4:
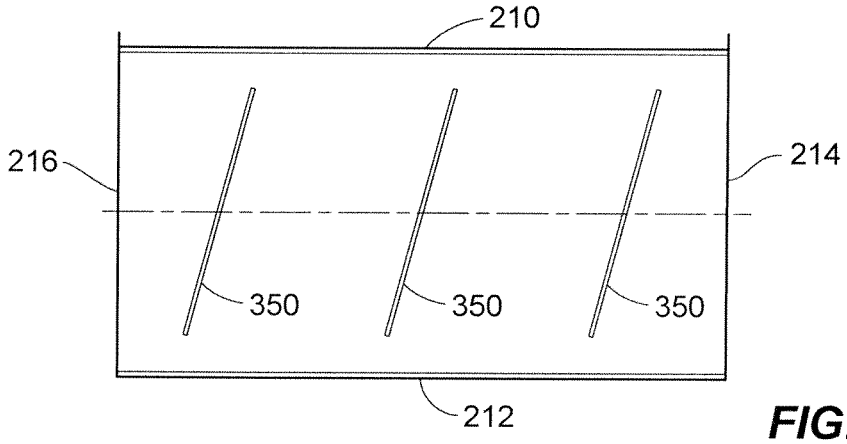
FIG. 4 is a plan view of the liner segment of FIG. 3.
Figure 5:
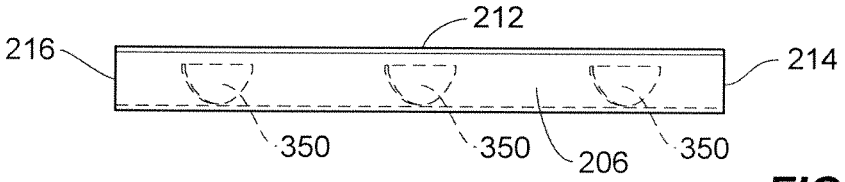
FIG. 5 is a side view of the liner segment of FIG. 3.

Returning now to FIGS. 1 and 2, and with reference to FIG. 4, it will be recognized that the liner 200 of the drum 102 is in fact made up of a plurality of liner segments 202 arranged about the inner surface 106 of the drum with sides 210, 212 adjacent to each other, and with ends 214, 216 adjacent each other. In regard to the arrangement about the inner surface 106, FIG. 2 illustrates that four liner segments 202 are arranged about the inner surface 106 of the drum 102 with four retainers 260 arranged between adjacent liner segments 202. It will be recognized that, depending on the size of the segments 202 relative to the inner surface 106 of the drum 102, a larger or smaller number of segments 202 may be used in any particular embodiment. In regard to the arrangement along the inner surface 106, at least one interface 360 is shown in FIG. 1 between adjacent liner segments 202 disposed in the drum 102 end-to-end. In fact, at least three liner segments 202 are arranged along the inner surface 106 of the drum 102 end-to-end. Again, it will be recognized that the number of segments 202 lying along the inner surface 106 of the drum may vary according to the length of the segments 202 and the length of the drum 102, and according to whether space is permitted between the ends of the segments 202.

Thus, it will be further recognized that the drum has opposing ends 370, 372 and a drum length measured from one 370 of the opposing ends to the other 372, and each liner segment 202 has a segment length measured from one 214 of the opposing ends to the other 216, the segment length being shorter than the drum length as illustrated. Furthermore, the retainer 260 has opposing ends 276, 278 and a retainer length measured from one 276 of the opposing ends to the other 278, the retainer length being substantially equal to the segment length and shorter than the drum length as illustrated. Of course, these lengths may vary, such that the retainer length may be shorter than the segment length, for example. In the same fashion, the retainer length may be longer than the segment length, such that one retainer 260 attaches two or more segments 202 disposed end-to-end to the drum 102. Retainers 260 of varying sizes may even be used with segments 202 of a common size, or vice versa.

While the foregoing discussed the liner segments 202 and retainers 260 in terms of lined drum 102, it will be recognized that the liner segments 202 and retainers 260 may be provided separate from the drum 102, in the form of a kit. Such a kit may include, for example a plurality of liner segments 202 and at least one retainer 260 (more likely, a plurality of retainers 260). The liner segments 202 may have an outer surface that is adapted to face an inner surface of a drum with the side edges of adjacent liner segments being spaced from each other to define a space therebetween. Similarly, the at least one retainer 260 may be attachable to a wall of the drum in the space between the side edges of the adjacent liner segments. Even more, the liner segments 202 may be provided separately from the retainers 260.

To assemble the liner 200 in the drum 102, one may first dispose a liner segment 202 in the drum 102 with the outer surface 206 of the liner segment 202 facing the inner surface 106 of the drum 102. Further, an adjacent liner segment 202 may be disposed in the drum 102 with the outer surface 206 of the adjacent liner segment 202 also facing the inner surface 106 of the drum 102 and with one of the side edges 210 of the adjacent liner segment 202 spaced from one of the side edges 212 of the liner segment 202 to define the space 240 therebetween. The retainer 260 may then be attached to the wall 104 of the drum 102 in the space 240 with the side edges 264, 266 overlapping the side edges 210, 212 of the liner segments 202.

In fact, additional liner segments 202 may be disposed in the drum 102 with their outer surfaces 206 facing the inner surface 106 of the drum 102, and their side edges 210, 212 spaced to define the spaces 240 between adjacent liner segments 202. Additional retainers 260 may then be attached to the wall 104 of the drum 102 in the spaces 240 with the side edges 264, 266 of the additional retainers 260 overlapping the side edges 210, 212 of the liner segments 202. The additional liner segments 202 may be disposed in the drum 102 so that at least two liner segments 202 are arranged end-to-end.

Figure 8:
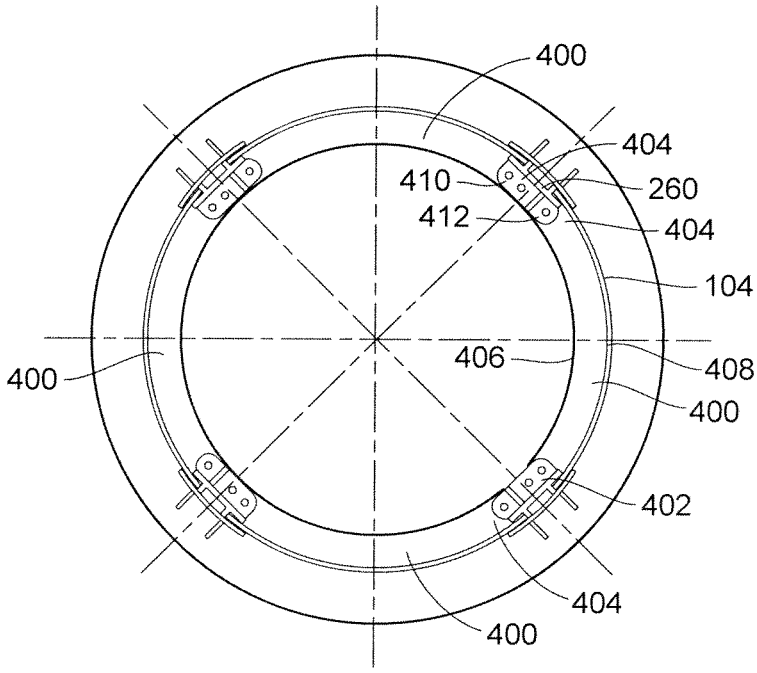
FIG. 8 is an end view of the drum of FIG. 1 with an optional partition attached

In addition to the liner segments 202 and retainers 260, other elements may also be added to the lined drum 102. For example, FIG. 8 illustrates an embodiment wherein a partition is included. The illustrated partition provides a partition that only extends a limited distance radially inwardly, such that the partition, or dam, has an annular appearance. It will be recognized that the partition could instead extend from the center of the drum 102 to its inner surface 106.

The partition, or dam, includes a plurality of dam pieces 400. As illustrated, the particular embodiment includes four dam pieces 400. According to other embodiments, the partition could include additional pieces, or be defined by a single piece. According to at least one embodiment, the pieces 400 may be made of metal.

The dam pieces 400 have spaced ends 402, 404 and curved inner and outer edges 406, 408. The curvature of the outer edge 408 may be complementary to the inner surface 204 of the liner segments 202. As illustrated, the inner and outer edges 406, 408 have a uniform spacing, such that the curvature of the inner edge 406 is similar to that of the outer edge 408; according to other embodiments, this need not be the case. As illustrated then, the inner edges 406 of the dam pieces 400 define a circular opening with a diameter smaller than the diameter of the lined drum 102.

The ends 402, 404 may be attached to the retainers 260. As illustrated, the retainers are fitted with flanges 410, 412 to which the ends 402, 404 may be attached. It will be recognized that these flanges 410, 412 may be positioned anywhere along the length of the retainer 260, which provides a great deal of flexibility in the placement of the dam pieces 400. As illustrated, the ends 402, 404 have apertures formed therethrough, and the flanges 410, 412 have apertures formed therethrough. Fasteners, such as nut and bolt combinations, may be disposed through the aligned apertures to secure the ends 402, 404 to the flanges 410, 412.

FIGS. 9-13 illustrate an alternative embodiment for a lined drum 500. The lined drum 500 may be interchangeable with the drum 102 as described in accordance with FIG. 1. That is, the lined drum 500 may include one or more mechanisms for moving the lined drum 500. For example, the lined drum 500 may have a motor with an associated drive similar to the motor 120 and drive 122 of FIG. 1. The motor and associated drive, similarly, may cause the drum 500 to rotate about an axis collinear with a longitudinal axis of the lined drum 500. Also similar to the apparatus as described in FIG. 1, the drive may also include one or more gears, with a first gear attached to the shaft of the motor.

Returning to FIG. 9, the lined drum 500 includes a drum 502, a plurality of bar segments 504, a plurality of liner segments 506, and a plurality of retainers 508. The drum 502 and the plurality of liner segments 506 may be similar to the drum 102 and liner segments 202 of the previous embodiment described in FIGS. 1-8. Thus, the disclosure of the previous embodiment and variants thereof may apply to the alternative embodiment described herein with reference to FIGS. 9-13 with certain similarities addressed below. This is not intended to be an exhaustive catalogue of all similarities.

Figure 9:
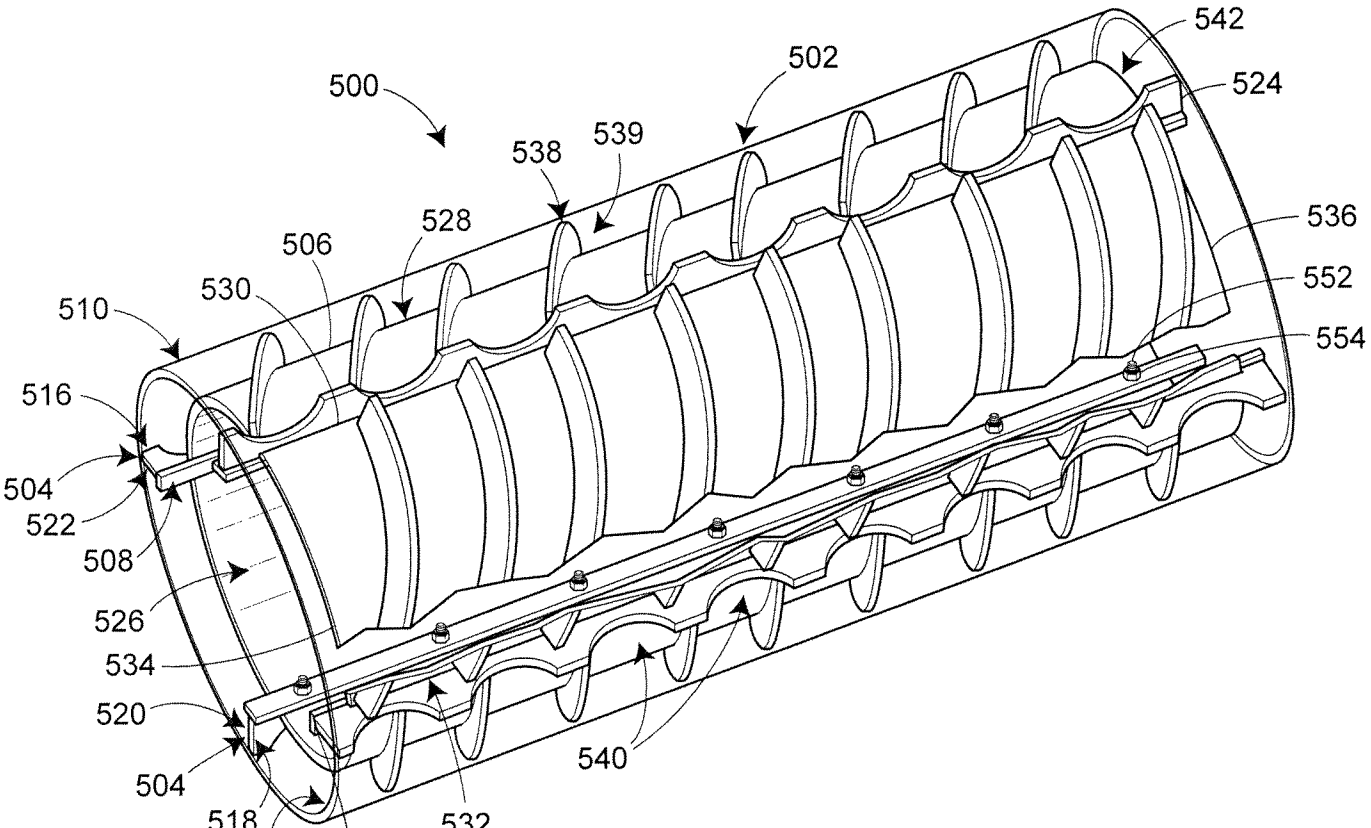
FIG. 9 is a perspective view, with a partial cutaway, of an alternative drum with a plurality of liner segments mounted therein.
Figure 12:
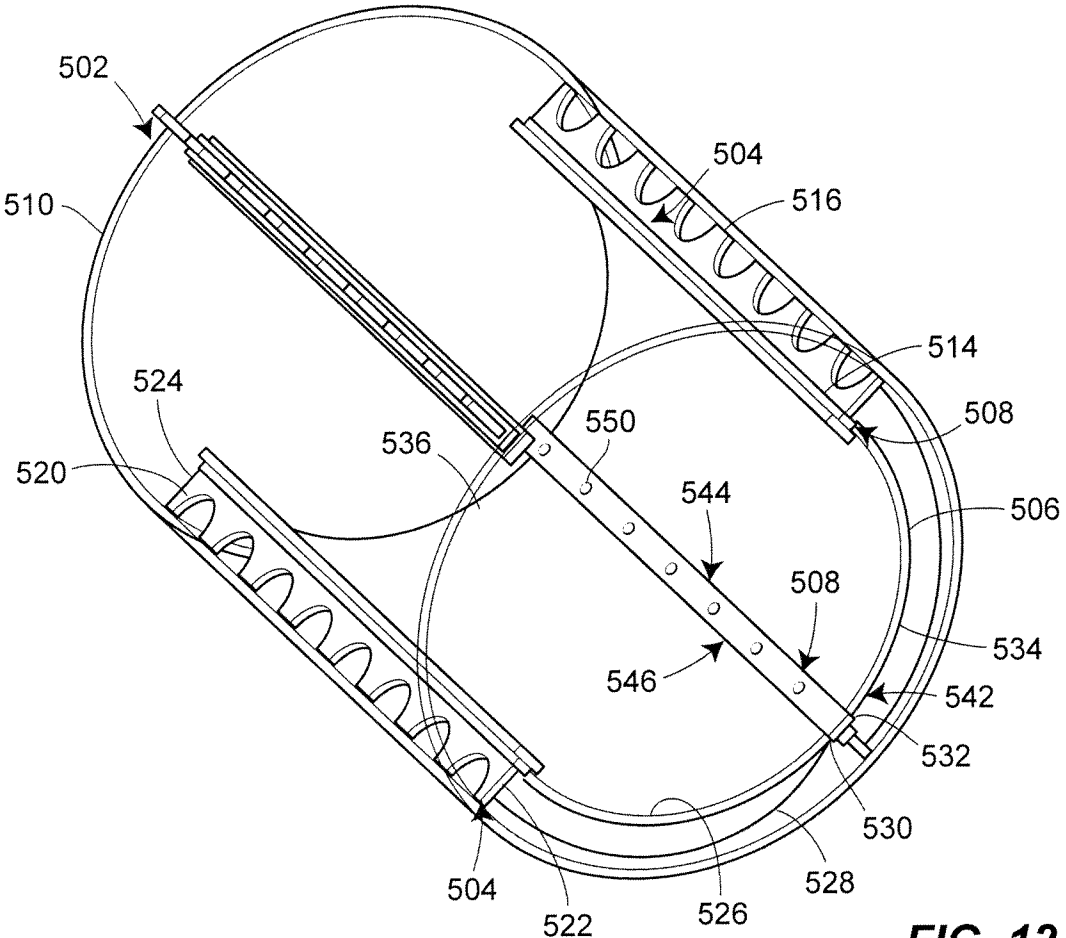
FIG. 12 is another perspective view of the drum of FIG. 9, illustrating the placement of the plurality of bar segments.
Figure 13:
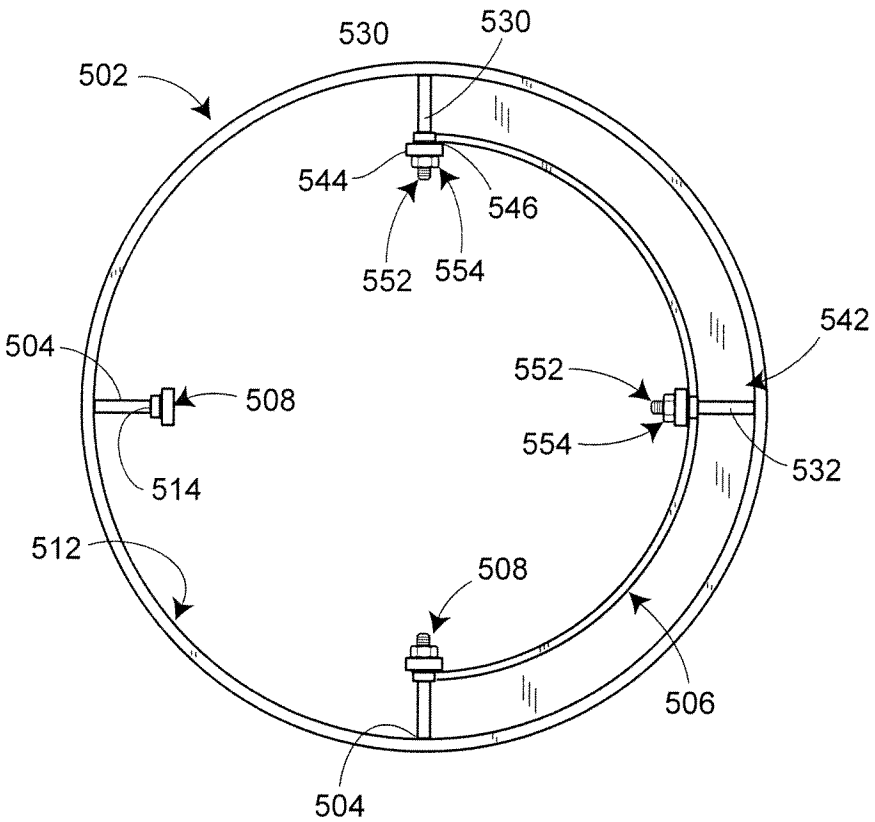
FIG. 13 is an end view of the drum of FIG. 9 with two of the plurality of bar segments installed.

The drum 502 has a wall 510, as best seen in FIGS. 9, 12 and 13. The wall 510 of the drum 502 has an inner surface 512. The inner surface 512 of the wall 510 of the drum 502 is curved as illustrated; in fact, as illustrated, the cross-section of the drum 502 is circular (See FIG. 13). It will be recognized, however, that the cross-section of the drum is not limited to a circular cross-section, and that other cross-sectional shapes are also possible. The wall 510 of the drum 502 may be made of metal.

Figure 10:
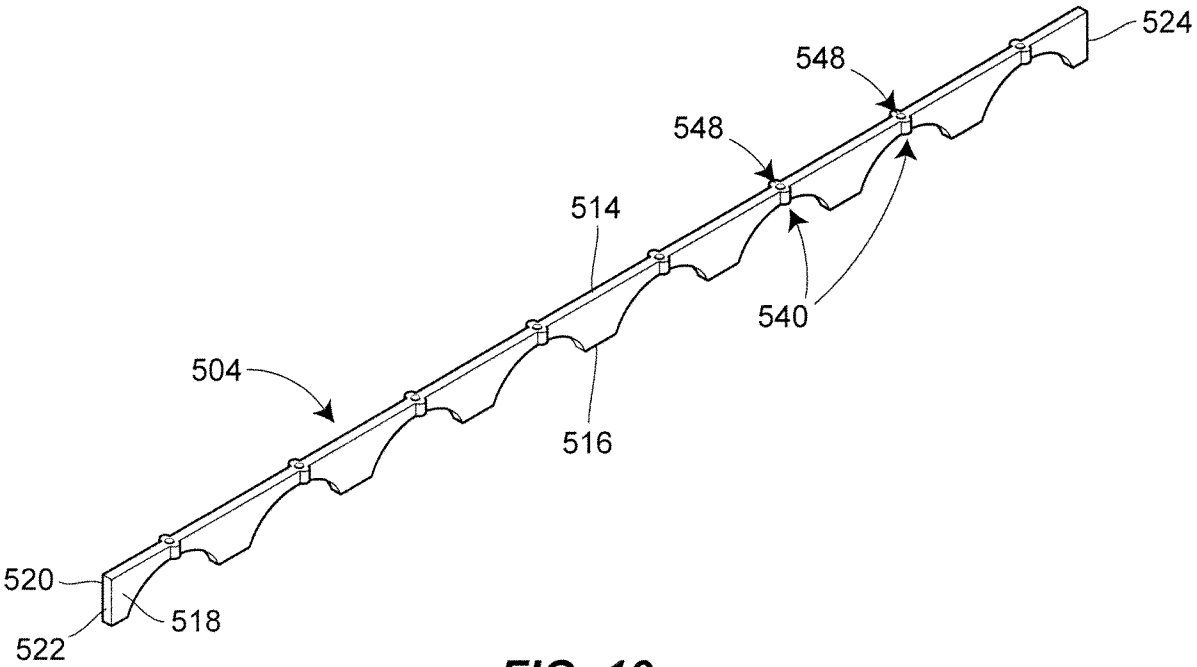
FIG. 10 is a side view of one of the plurality of bar segments illustrated in FIG. 9.

As seen in FIGS. 9, 10 and 12, each of the plurality of bar segments 504 has inner and outer opposing ends 514, 516. Each of the plurality of bar segments 504 also has opposing side edges 518, 520 and opposing end edges 522, 524, as best seen in FIG. 10. While the side edges 518, 520 and end edges 522, 524 are parallel as illustrated, the present disclosure would also embrace embodiments wherein the side edges 518, 520 and end edges 522, 524 were not parallel. In fact, the edges 518, 520, 522, 524 may be irregular, or shaped so that adjacent edges 518, 520, 522, 524 of adjacent bar segments 504 are complementary according to geometry other than that shown (i.e., where all edges are straight and parallel). The bar segment 504 also has a thickness between the opposing side edges 518, 520. According to at least one embodiment, the bar segments 504 may be made of metal.

The outer end 516 of each of the plurality of bar segments 504 may be permanently attached to the inner surface 512 of the drum 502 by welding, for example. Alternatively, the bar segment 504 may be removable and may be attached to the inner surface 512 of the drum 502 using a nut and bolt combination. Apertures (not shown) may be disposed throughout the bar segments 504 with corresponding apertures in the wall 510 of the drum 502. With the apertures of the bar segments 504 and of the wall 510 of the drum 502 aligned, a bolt may be disposed through the apertures and a nut threaded on to an end of the bolt. Other alternatives are also possible.

The inner surface 512 of the drum 502 is curved. The outer end 516 of each of the plurality of bar segments 504 may also be curved so as to be complimentary to the inner surface 512 of the drum 502. It will be recognized, however, that the inner surface 512 of the drum 502 and the outer end 516 of each of the plurality of bar segments 504 need not be complementary. That is, although the drum 502 may have a circular cross section, it is possible for the outer end 516 of each of the plurality of bar segments 504 be planar because the ratio of the thickness between the opposing side edges 518, 520 compared to the curvature of the inner surface 512 of the drum 502 is sufficiently small. In fact, there may be a manufacturing advantage in using bar segments with planar outer ends, as this would be simpler to manufacture and/or machine, thereby reducing the overall costs of manufacturing.

Figure 11:
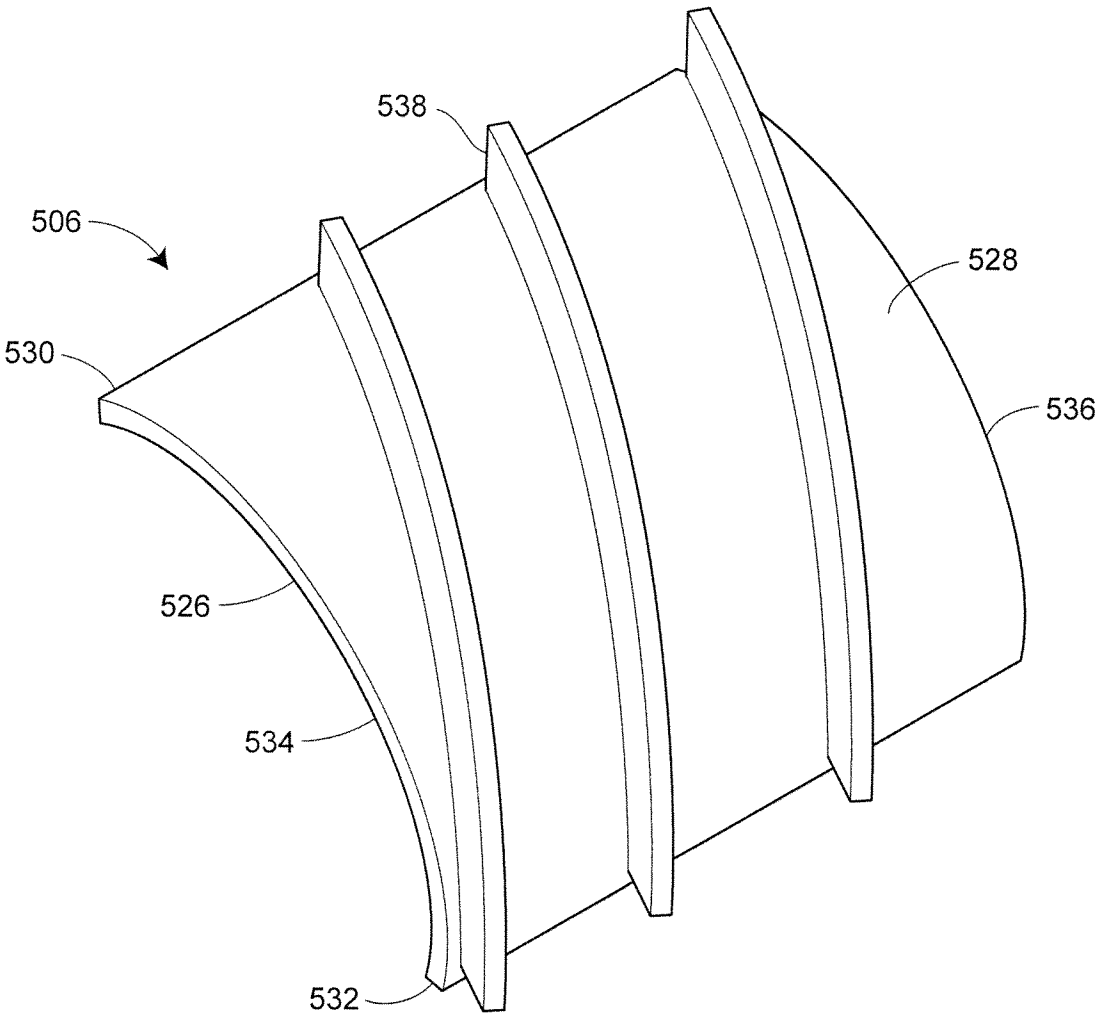
FIG. 11 is a side view of the liner segment of FIG. 9.

Disposed between the bar segments 504 are liner segments 506. As best seen in FIGS. 9 and 11, each liner segment 506 has inner and outer opposing surfaces 526, 528. The liner segments 506 also have opposing side edges 530, 532 and opposing end edges 534, 536. While the side edges 530, 532 and end edges 534, 536 are parallel as illustrated, the present disclosure would also embrace embodiments wherein the side edges 530, 532 and end edges 534, 536 were not parallel. In fact, the edges 530, 532, 534, 536 may be irregular, or shaped so that adjacent edges 530, 532, 534, 536 of adjacent liner segments 506 are complementary to the bar segment 504 profile according to geometry other than that shown (i.e., where all edges are straight and parallel). The liner segment 506 also has a thickness between the inner and outer opposing surfaces 526, 528. According to at least one embodiment, the segments 506 may be made of metal.

As illustrated, the outer surface 528 of the liner segment 506 is curved. In particular, the outer surface 528 of the inner segment 506 is curved so as to be complementary to the curved inner surface 512 of the wall 510 of the drum 502. As such, where the cross-section of the drum 502 is circular, the outer surface 528 of the liner segment 506 will represent a sector of a circle having the same center as that of the drum 502 (see, in particular, FIG. 13). The inner surface 512 of the drum 502 faces the outer surface 528 of the liner segment 506 with the outer surface 528 facing the inner surface 512 and maintaining a space therebetween.

It will be recognized that the inner surface 512 of the drum 502 and the outer surface 528 of the liner segments 506 need not be complementary. That is, it may be possible for the drum 502 to have a circular cross-section, but the curvature of the outer surface 528 of the liner segment 506 to be such that the spacing between the inner surface 512 of the drum 502 and the outer surface 528 of the liner segment 506 is not uniform, but may vary between the side edges 530, 532 of the liner segment 506. For example, points on a line equidistant from the edges 530, 532 may be closer to the inner surface 512 of the drum 502 than points on either edge 530, 532.

Additionally, the liner segments 506 may also include a series of vanes 538 extending from one side edge 530 of the liner segment 506 to the opposing side edge 532 of the liner segment 506 between the outer surface 528 of the liner segment 506 and the inner surface 512 the drum 502 defining a space 539. The liner segments 506 may be perforated allowing loose particles collected during operation of the apparatus 500 to pass through the liner segments 506 and collecting in the space 539 between the outer surface 528 of the liner segment 506 and the inner surface 512 of the wall 510. In fact, the vanes 538 may guide the loose particles in a specific direction depending upon the motion of the drum 502 and the angle of the vanes 538. As best illustrated in FIGS. 9, 10, and 12, the outer end 516 of each of the plurality of bar segments 504 may include a series of openings 540 for the loose particles to pass through. The openings 540 may be aligned with the vanes 538 to define a space through which the particles may pass to an output. As illustrated, the openings 540 may be semi-circular, although other shaped openings, such as rectangular or triangular openings, for example, may be appropriate as well.

Referring now to FIGS. 9, 12, and 13, it will be recognized that a plurality of liner segments 506 may be arranged about the inner surface 512 of the drum 502 forming a liner 542. The liner 542 is formed with a side edge 530 of one of the plurality of liner segments 506 and a side edge 532 of an adjacent liner segment 506 facing the opposing side edges 518, 520 of one of the plurality of bar segments 504. The side edges 530, 532 of the adjacent liner segments 506 may be spaced from each other to define a space therebetween as described in the embodiment of FIGS. 1-8. The space may permit side edges 530, 532 to move relative to each other, for example to permit thermal expansion or contraction. Alternatively, as illustrated, the side edges 530, 532 of the adjacent liner segments 506 may abut against the opposing side edges 518, 520 of one of the plurality of bar segments 504.

At least one retainer 508 is provided between every two adjacent liner segments 506. The at least one retainer 508 includes opposing side edges 544, 546 which are adapted to overlap the side edges 530, 532 of the adjacent liner segments 506 as shown in FIGS. 9, 12, and 13. The retainers 508 may be adapted to be attached to the inner end 514 of one of the plurality of bar segments 504, thereby securing the adjacent liner segments 506 against the inner surface 512 of the drum 502.

One mechanism for attaching the retainer to the bar segment is illustrated. As best seen in FIG. 10, each of the plurality of bar segments 504 may include apertures 548. The apertures 548 may be spaced at a constant distance from each other, as illustrated, or may be staggered in such a way that no two apertures 548 of adjacent bar segments 504 are aligned. The corresponding retainer 508 for each of the plurality of bar segments 504 may also contain apertures 550, as best shown in FIG. 12, corresponding to the opposing bar segment aperture 548. The retainer 508 may be attached to the bar segment 504 with a removable fastener such as a bolt 552 and nut 554 combination as shown in FIG. 12. With the apertures 548, 550 aligned, the bolt 552 may be disposed through the apertures and the nut 554 threaded on to an end of the bolt.

It will be recognized that the foregoing is merely an example of one mechanism for attaching the retainer 508 to the bar segment 504. Other mechanisms may be used. For example, the bolt may have an end fixedly attached to the retainer 508, by welding, for example. Other alternatives are possible.

Similar to the apparatus 100 of FIGS. 1-8, it will be recognized that the bar segments 504, the liner segments 506, and the retainers 508 may be provided separate from the drum 502, in the form of a kit. Such a kit may include, for example a plurality of bar segments 504, a plurality of liner segments 506, and at least one retainer 508 (more likely, a plurality of retainers 508). A plurality of bar segments 504 may have an outer end adaptable to be attached to the inner surface 512 of a drum 502. The liner segments 506 may have an outer surface 528 that is adapted to face an inner surface 512 of a drum 502 with the side edges 530, 532 of adjacent liner segments 506 facing an opposing side edge 518, 520 of a common bar segment 504. As a still further embodiment, the bar segments 504, and the liner segments 506 may be provided separately from the retainers 508.

To assemble the liner 542 in the drum 502, one may first attach a bar segment 504 to the drum 502 with the outer end 516 of the bar segment 504 facing and attached to the inner surface 512 of the drum 502. Further, a liner segment 506 may be disposed in the drum 502 with the outer surface 528 of the liner segment 506 facing the inner surface 512 of the drum 502 with one of the side edges 530 of the liner segment 202 facing one of the side edges 518 of the bar segment 504. An adjacent liner segment 506 similarly disposed in the drum 502 with a side edge 532 facing the opposing side edge 520 of the bar segment 504. The retainer 508 may then be attached to inner end 514 of the bar segment 504 with the side edges 544, 546 overlapping the side edges 530, 532 of the liner segments 506 as best seen in FIG. 13.

In fact, additional bar segments 504 and liner segments 506 may be disposed in the drum 502 with their outer ends 516 and outer surfaces 528 facing the inner surface 512 of the drum 502. The side edges 530, 532 of the additional liner segments 506 would similarly face the side edges 518, 520 of the opposing bar segments 504. Additional retainers 508 may then be attached to the inner end 514 of the bar segment 504 with the side edges 544, 546 of the retainers 508 overlapping the side edges 530, 532 of the liner segments 506.

It is believed that the present disclosure may have several benefits, one or more of which may be present in a particular embodiment according to the present disclosure.

For example, when it becomes necessary to replace liners made of multiple elements, such as are illustrated in U.S. Pat. Nos. 4,502,808, 6,273,176, and 6,595,267, for example, it may be necessary to remove a significant number of the liner elements before the damaged liner element can be removed. This is caused by the interlocking nature of the liner elements and their alignment along the length of the drum. However, according to the present disclosure, replacement of a damaged liner segment 202, 506 may be performed without removal of any liner segment 202, 506 other than the damaged liner segment 202, 506. That is, the liner segment 202, 506 may be selected, at least one of the retainers 260 or retainers 508 overlapping the liner segment 202, 506 may be removed, and then the liner segment 202, 506 may be removed from the drum 102, 502.

As another example, again relative to the liners referred to in the above-mentioned patents, given the interlocking nature of the elements in these systems, no provision is possible to permit the thermal expansion or contraction of the individual elements, as such provision would also serve to weaken the structural integrity of the liner as a whole. As a consequence, thermal expansion may cause buckling in the liner in such systems. To the contrary, the present liner provides spaced edges to permit thermal activity within the individual liner segments 202, 506.

As still another example, liners such as are made from the interlocking liner elements discussed in the above-mentioned patents rely upon the other liner elements of the system for the structural integrity of the overall liner. Given that there is no positive attachment of the liner elements of the other systems to the drum, once the liner elements begin to rise from the bottom of the drum along the wall to the top of the drum during installation, it is possible for the liner elements to fall inwardly and downwardly. This circumstance leads to increased assembly times and decreased safety relative to the liner according to present disclosure. On the other hand, the liners according to the present disclosure permit positive attachment between the liner and the drum in which it is placed, which may limit the safety concerns with the present liner and thus permit faster assembly times.

What is claimed is:

1. A lined drum comprising:

a drum with a longitudinal axis including a wall with an inner surface;

a plurality of liner segments, each liner segment having inner and outer opposing surfaces, opposing side edges aligned with the longitudinal axis, and opposing end edges, the outer surface of the liner segment facing the inner drum surface and the side edges of adjacent liner segments being spaced from each other to define a space therebetween;

at least one retainer having opposing side edges overlapping the side edges of the adjacent liner segments on the inner surface of the liner segments, the at least one retainer attached to the wall of the drum in the space between the side edges of the adjacent liner segments with the side edges of both the adjacent liner segments disposed between the retainer and the wall to attach the adjacent liner segments to the wall and the side edges of both the adjacent liner segments free to move within the space; and a drive coupled to the drum to rotate the drum about an axis collinear or non-collinear with the longitudinal axis.

2. The lined drum of claim 1, wherein the inner surface of the drum is curved, and the outer surface of each liner segment is curved so as to be complementary to the inner surface of the drum.

3. The lined drum of claim 1, wherein the at least one retainer comprises a plate having opposing side edges overlapping the side edges of adjacent liner segments.

4. The lined drum of claim 1, wherein each liner segment has a thickness between the inner and outer surfaces, and further comprising a spacer to be disposed in the space between adjacent liner segments, the spacer having inner and outer surfaces with a thickness between the inner and outer surfaces that is substantially equal to the thickness of each liner segment and side edges spaced from the side edges of the adjacent liner segments to permit the movement of the side edges of the adjacent liner segments.

5. The lined drum of claim 1, wherein the wall of the drum has an aperture and the at least one retainer has an aperture, and a fastener is disposed through the apertures in the wall of the drum and the at least one retainer to attach the at least one retainer to the drum.

6. The lined drum of claim 1, further comprising at least one bar segment, the at least one bar segment having inner and outer opposing ends, opposing side edges, and opposing end edges, the outer end of the at least one bar segment attached to the wall of the drum, the side edge of one of the plurality of liner segments and the side edge of an adjacent liner segment facing the opposing side edges of the at least one bar segment, and the at least one retainer attached to the inner end of the at least one bar segment.

7. The lined drum of claim 6, wherein each of the plurality of liner segments includes a series of vanes extending from one side edge to the opposing side edge of the liner segment and disposed between the outer surface of the liner segments and the inner drum surface.

8. The lined drum of claim 6, wherein the at least one bar segment and the at least one retainer each have apertures, the apertures of the at least one retainer are aligned with the apertures of the at least one bar segment, and a fastener is disposed through an aligned pair of apertures of the at least one retainer and the at least one bar segment.

9. The lined drum of claim 1, wherein at least one of the plurality of liner segments has a projection attached to the inner surface of the at least one of the plurality of liner segments.

10. The lined drum of claim 1, comprising a layer of insulation disposed between the inner surface of the drum and the outer surface of each liner segment.

11. The lined drum of claim 1, wherein the drum has opposing ends and a drum length measured from one of the opposing ends to the other, and each liner segment has a segment length measured from one of the opposing ends to the other, the segment length being shorter than the drum length.

12. The lined drum of claim 11, wherein the at least one retainer has opposing ends and a retainer length measured from one of the opposing ends to the other, the retainer length being substantially equal to the segment length and shorter than the drum length.

13. The lined drum of claim 11, wherein at least two liner segments are arranged end-to-end along the drum length.

14. A liner kit for a drum with a wall having an inner surface, the kit comprising:

a plurality of liner segments, each liner segment having inner and outer opposing surfaces, opposing side edges, and opposing end edges, the outer surface of the liner segment adapted to face the inner surface of the drum with the side edges of adjacent liner segments being spaced from each other to define a space therebetween; and at least one retainer having opposing side edges to overlap the side edges of the adjacent liner segments on the inner surface of the liner segments, the at least one retainer attachable to the wall of the drum in the space between the side edges of the adjacent liner segments with the side edges of both the adjacent liner segments disposed between the retainer and the wall to attach the adjacent liner segments to the wall and the side edges of both the adjacent liner segments free to move within the space.

15. The method of assembling a liner in a drum having an inner surface, the method comprising:

disposing a liner segment having inner and outer surfaces, opposing side edges, and opposing end edges in the drum with the outer surface of the liner segment facing the inner surface of the drum;

disposing an adjacent liner segment having inner and outer surface, opposing side edges and opposing end edges in the drum with the outer surface of the adjacent liner segment facing the inner surface of the drum with one of the side edges of the adjacent liner segment spaced from one of the side edges of the liner segment to define a space between the liner segments;

attaching a retainer having opposing side edges overlapping the side edges of the liner segments on the inner surface of the liner segments to the wall of the drum in the space between the side edges of the liner segments with the side edges of both the adjacent liner segments disposed between the retainer and the wall to attach the adjacent liner segments to the wall and the side edges of both the adjacent liner segments free to move within the space; and rotating the drum about an axis collinear or non-collinear with a longitudinal axis of the drum.

16. The method of claim 15, comprising:

disposing additional liner segments in the drum, the additional liner segments having inner and outer surfaces, opposing side edges, and opposing end edges, so that each of the liner segments has side edges spaced from side edges of other liner segments to define a space between adjacent liner segments; and attaching retainers having opposing side edges overlapping the side edges of the liner segments to the wall of the drum in the space between the side edges of the liner segments.

17. The method of claim 16, comprising:

disposing the additional liner segments in the drum so that at least two liner segments are arranged end-to-end.

18. The method of claim 15, comprising:

selecting a liner segment that has additional liner segments disposed adjacent the opposing side edges and adjacent the opposing end edges;

removing at least one retainer that overlaps one of the side edges of the liner segment; and removing the liner segment from the drum.

19. The method of claim 15, comprising:

attaching to a wall of the drum at least one bar segment, the at least one bar segment having inner and outer opposing ends and opposing side edges;

disposing a liner segment with one side edge of the liner segment facing the side edge of the at least one bar segment;

disposing an adjacent liner segment with one side edge of the adjacent liner segment facing the side edge of the at least one bar segment; and attaching the retainer having opposing side edges overlapping the side edges of the liner segments to the inner end of the bar segment.

* * * * *